US005418517A

United States Patent [19]

Matherne et al.

[11] Patent Number: 5,418,517

[45] Date of Patent: May 23, 1995

[54] BASKETBALL SCORING APPARATUS

[75] Inventors: Lonny R. Matherne, Ogden; Barry D. Mower, Layton, both of Utah

[73] Assignee: Lifetime Products, Inc., Clearfield, Utah

[21] Appl. No.: 100,451

[22] Filed: Jul. 30, 1993

Related U.S. Application Data

[63] Continuation-in-part of Ser. No. 829,455, Jan. 31, 1992, Pat. No. 5,294,913.

[51] Int. Cl.[6] ..... G08B 23/00

[52] U.S. Cl. ..... 340/323 R; 273/1.5 R; 116/222; 377/5; 364/411

[58] Field of Search ..... 364/410, 411; 377/5; 340/323 R; 273/1.5 R; 116/222

[56] References Cited

U.S. PATENT DOCUMENTS

| | | | |
|---|---|---|---|
| Re. 13,239 | 5/1911 | Lindemeyer . | |
| 170,627 | 11/1875 | Harris . | |
| 466,464 | 1/1892 | Hood et al. . | |
| 2,372,705 | 4/1945 | Bicker . | |
| 4,045,788 | 8/1977 | Castelli et al. | 340/323 R |
| 4,097,855 | 6/1978 | Salvo | 340/323 R |
| 4,822,042 | 4/1989 | Landsman | 340/323 R |
| 4,858,920 | 8/1989 | Best | 273/1.5 R |
| 4,904,981 | 2/1990 | Mele et al. | 340/323 R |
| 4,956,775 | 9/1990 | Klamer et al. | 364/411 |
| 4,999,603 | 3/1991 | Mele et al. | 340/323 R |

OTHER PUBLICATIONS

Lifetime Products, Inc., "Double Shot," Product Brochure.

Lifetime Products, Inc. "Quarterback Challenge Model #9988," Product Brochure.

Triple Play Games, "Operation of the Electronic Score Keeper," Instructions.

Lifetime Products, Inc., "Shoot-n-Score Electronic Basketball Scoreboard," Product Brochure.

Taliq Corporation, "Varilite Color Displays," Product Brochure.

Jaguar Technologies, Ltd., "Hoop Score The Official Scorekeeper of Driveway Basketball Model JH 1000," Product Brochure.

Jaguar Technologies, Ltd., "Hoop Score The Official Scorekeeper of Driveway Basketball," Product Brochure.

Jaguar Technologies, Ltd., "Hoop Score The Official Scorekeeper of Driveway Basketball Model JH1000," Instruction Manual.

*Primary Examiner*—Donald J. Yusko
*Assistant Examiner*—Michael Day
*Attorney, Agent, or Firm*—Madson & Metcalf

[57] ABSTRACT

A portable electronic scoreboard apparatus attachable to a basketball goal is disclosed. The apparatus comprises an electronic analysis and report mechanism capable of receiving input information, analyzing the information according to a mode of operation, and reporting output information which includes an indication of the number of successful shots and an indication of the shooting percentage. The apparatus also comprises an attempt detection means for detecting contact of a basketball with the basketball goal and sending a contact signal to the electronic analysis and report mechanism, and for detecting the successful passage of a basketball through the hoop and sending a passage signal to the electronic analysis and report mechanism. In a preferred embodiment, the contact signal arises in response to vibration of a piezoelectric vibration sensor, and the passage signal arises in response to movement of a paddle beneath the hoop by the basketball. Spurious passage and contact signals are preferably prevented by the use of a paddle filter and a vibration filter, respectively. The paddle is attached beneath the hoop by an attachment assembly which includes notched arms engaging a gear that is rotatable by a player. The arms have grooved feet for engaging the basketball rim plate. A releasable gear locking mechanism holds the arms in place to prevent the feet from being disengaged by repeated impacts of the basketball against the paddle.

14 Claims, 5 Drawing Sheets

BASKETBALL SCORING APPARATUS

RELATED U.S. APPLICATION

This application is a continuation in part of application Ser. No. 07/829,455 filed Jan. 31, 1992, now U.S. Pat. No. 5,294,913 and entitled INDOOR/OUTDOOR PORTABLE BASKETBALL SCOREBOARD.

THE FIELD OF THE INVENTION

The present invention relates to an apparatus for regulating play in a basketball game, and more particularly to a portable device for detecting, analyzing, and reporting attempts to score during basketball games.

BACKGROUND OF THE INVENTION

Many people play the sport of basketball and devote considerable time to the development of their basketball skills, particularly in the United States. Millions of basketball goals have been mounted on barns, telephone poles, garages, and the like so basketball enthusiasts can conveniently enjoy a game together or shoot a few baskets in solitude. In recent years, many residential basketball poles carrying a backboard and a hoop have been installed next to a driveway or street. Portable basketball standards are also becoming commercially available for those basketball enthusiasts who do not have the necessary space or permission to have a basketball standard permanently installed. Once a backboard and hoop of some type are in place, a game of basketball soon follows.

Depending on the number of players available, the game may be a standard competition between two teams, a free throw or 3-point shooting contest, or any of a number of derivative games such as "HORSE" or "Around the World." But with any game of basketball played at a residential basketball standard, two aspects of the game often differ from a regulation game. A friendly game at a school yard, on a driveway, or in the street will generally involve no neutral referees, and will often lack a scoreboard.

Unfortunately, the lack of these two elements sometimes leads to disputes. Arguments over the score, who gets possession of the ball, and how long to play have disrupted many a friendly game. To compensate for the lack of independent officials, players in a friendly neighborhood game often call their own fouls and infractions. To compensate for the lack of regulation scoreboards, portable scoreboards have been developed. One such scoreboard, herein denoted the "previous scoreboard," is disclosed in U.S. patent application Ser. No. 07/829,455, a parent application of the present case.

Although it represents an advance over flip-cards or similar manual scoring approaches, the previous scoreboard does have limitations. The previous scoreboard detects successful shots by means of a score registering assembly which is releasably attachable to a basketball goal. Signals indicating successful shots are transmitted from the score registering assembly to an electronic mechanism that is attachable to a basketball pole. The electronic mechanism analyzes input information received from the score registering assembly and other sources, and reports output information through a visual display.

The score registering assembly includes a switch and a paddle. The paddle, which is positioned just below the basketball hoop, is movable between a ready position and a reactive position. A cam on the paddle actuates the switch if a basketball successfully passes through the basketball hoop and thus causes the paddle to move from the ready position to the reactive position. The switch communicates such successful shots to the electronic mechanism.

On rare occasions, however, a single passage of a basketball may cause the paddle to bounce in and out of the reactive position several times. The oscillating paddle may in turn actuate the switch several times, thereby sending multiple signals to the electronic mechanism indicating successful shots. In fact, however, all signals immediately following the first signal are in error, because the ball passed through the hoop just once.

Another limitation of the previous scoreboard is that it cannot calculate shooting percentages because it can only detect successful shots. If a basketball strikes the hoop or backboard, but does not pass through the hoop, the paddle is not moved to the reactive position, the switch is not actuated, and no signal is sent to the electronic mechanism. Because it cannot detect unsuccessful shots, the previous scoreboard cannot calculate the number of successful shots as a percentage of the total number of attempted shots.

To detect passage of the basketball through the hoop, portable scoreboards typically include a passage sensor of some kind attached to the basketball standard near the hoop. For instance, the score registering assembly of the previous scoreboard has an adjustable arm attachment assembly containing two arms that are laterally adjustable for clamping engagement with a rim plate portion of the basketball goal. The movement of the arms is controlled by rotation of a knob. The knob has a gear that engages notches in each arm and advances or retracts each arm as the knob is turned, depending on the direction of rotation.

A drawback of some conventional passage sensor attachment assemblies is that the repeated impacts of the basketball against the basketball standard tend to loosen the attachment of the sensor assembly to the standard. Thus, play must be periodically interrupted to verify that the attachment assembly continues to hold the sensor securely to the basketball standard. If the attachment fails, the sensor may fall. On impact, the fallen sensor may break or cause other damage.

Thus, it would be an advancement in the art to provide an apparatus for securely yet releasably engaging a score registering assembly so that repeated impacts on the assembly's paddle do not tend to loosen the assembly from the basketball goal.

It would also be an advancement in the art to provide a basketball scoring apparatus which detects successful shots but does not generate false scores if the paddle used to detect successful shots oscillates after being flipped by the basketball that went through the hoop.

It would be a further advancement in the art to provide a basketball scoring apparatus capable of detecting shots that hit the rim or backboard but do not pass through the hoop, and to provide such an apparatus capable of calculating and displaying shot percentages.

Such a basketball scoring apparatus is disclosed and claimed herein.

BRIEF SUMMARY OF THE INVENTION

The present invention includes a portable electronic scoreboard apparatus that is attachable to a basketball system for detecting, analyzing, and reporting attempts to score during basketball games. The portable electronic scoreboard apparatus includes an electronic analysis and report mechanism, also known herein as the "electronic mechanism." The electronic mechanism is in signal communication with an attempt detection means.

The electronic mechanism is housed for convenience and protection within a housing that may be mounted on a basketball pole, a wall, or another convenient location. The housing can be installed quickly and easily, and can be removed for storage so that the electronic mechanism is not stolen or vandalized.

The electronic mechanism has a visual display for reporting information, and an actuator for players to use in manually inputting information. Players may also enter information through a remote control device that is in wireless signal communication with the electronic mechanism. As explained below, the electronic mechanism receives additional information from the attempt detection means.

The electronic mechanism is capable of receiving input information, analyzing the input information according to a variety of modes of operation, and reporting output information. The input information includes the desired mode of operation, a passage signal indicating successful passage of a basketball through the basketball hoop, a contact signal indicating contact of a basketball with the backboard or hoop, and other useful information. The output information includes an indication of the number of successful shots, the time left on a shot clock, an indication of the shooting percentage, and other useful information related to basketball play.

As noted above, the portable electronic scoreboard apparatus also includes an attempt detection means for detecting attempts to score. The attempt detection means is attachable to a rim plate portion of a basketball goal. The attached attempt detection means detects contacts of a basketball with the basketball goal through a piezoelectric vibration sensor. If the vibration sensor is actuated by impact of the basketball against the basketball standard, the vibration sensor sends a vibration signal to a vibration filter. The vibration filter ignores all but the initial vibration signal during a predetermined period of time, sending one contact signal to the electronic mechanism in response to one or more contacts of the ball and standard within that time period.

The attempt detection means also detects the successful passage of a basketball through the basketball hoop and in response sends a passage signal to the electronic mechanism. The attempt detection means includes a paddle that is movable between a ready position and a reactive position. The paddle is capable of placement beneath the basketball hoop such that a basketball successfully passing through the hoop moves the paddle from the ready position to the reactive position. In so moving, the paddle actuates a nearby switch, which then sends a reactive paddle signal to a paddle filter.

The paddle filter prevents spurious passage signals from being sent for a predetermined period of time after the switch is initially actuated by the paddle. Although the paddle may occasionally be bounced in and out and back into the reactive position by the passing basketball, the paddle filter transmits at most one passage signal to the electronic mechanism during any period of time having a predetermined length.

Part of the attempt detection means is enclosed in a casing, which is attachable to the basketball goal by an attachment assembly. The attachment assembly includes a pair of notched arms that extend through openings in the casing. Each arm has a grooved foot configured to engage the rim plate portion of the basketball goal. Inside the casing, the arm notches engage a gear that is secured to a knob located outside the casing. As the knob is turned by a player preparing to play, the gear rotates and engages successive notches, thereby moving the arms. The feet of the arms move apart if the knob is turned one direction, and move closer together if the knob is turned the other direction.

The gear is part of a releasable gear locking mechanism that has an engaged position, in which a notch secured to the casing tends to prevent the gear from turning, and a released position, in which the gear is released from the notch and able to turn. The releasable gear locking mechanism also includes a spring that urges the gear into the engaged position. Thus, the attempt detection means may be releasably attached to the basketball goal in a manner that inhibits it from coming loose after repeated impacts of the basketball on the paddle.

These and other advantages and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
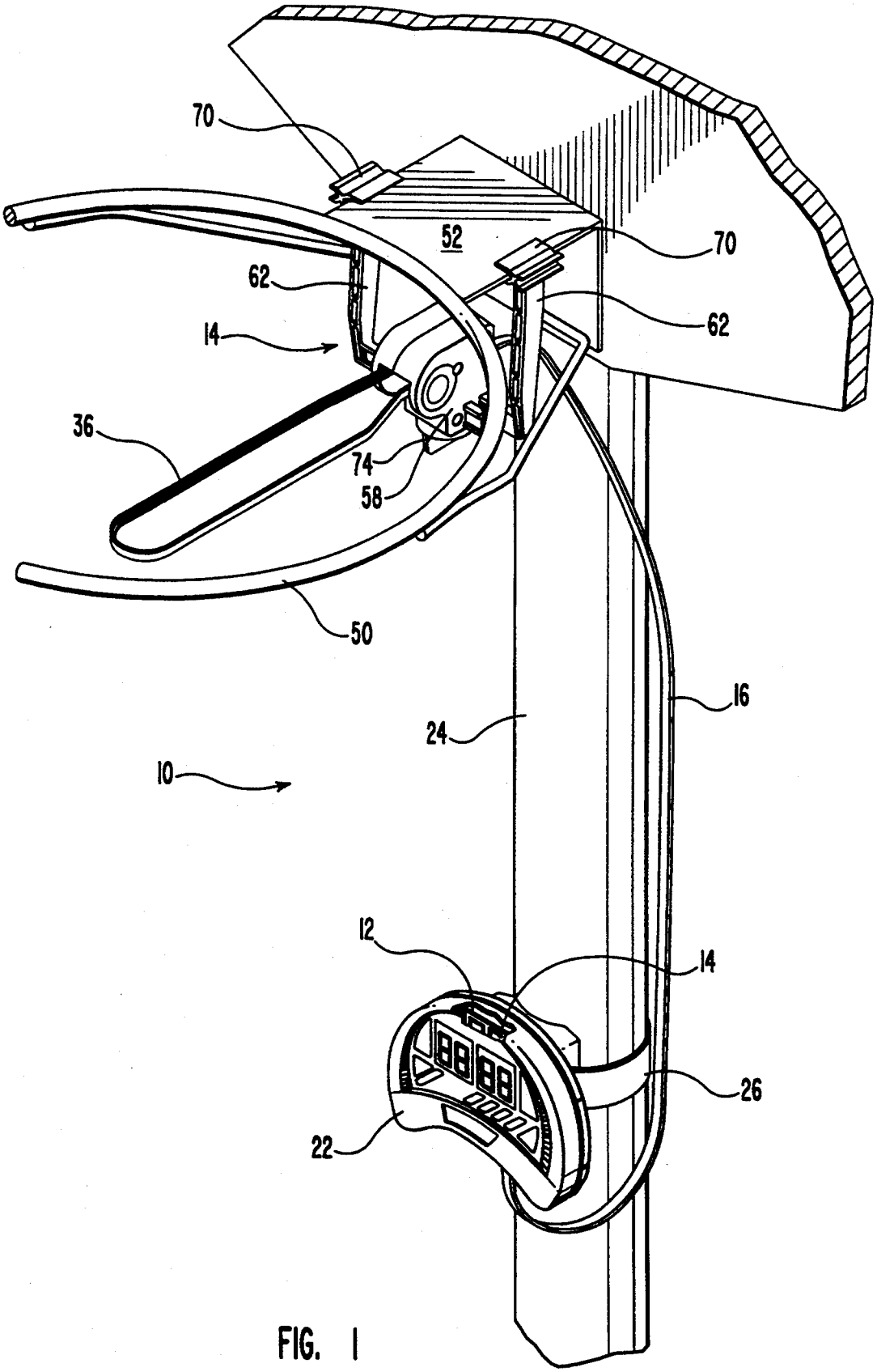
FIG. 1 is a perspective view of the portable electronic scoreboard of the present invention with a partial cut-away showing the electronic mechanism in its housing secured to a pole and connected to the attempt detection means, and showing the attempt detection means casing secured to the rim plate of a basketball goal with the net removed to more clearly illustrate the invention.

Reference is now made to the figures wherein like parts are referred to by like numerals throughout. In FIG. 1, a preferred embodiment of a basketball scoring apparatus according to the present invention is generally designated at 10. The present invention includes a portable electronic scoreboard apparatus that is attachable to a basketball system for detecting, analyzing, and reporting attempts to score during basketball games. The portable electronic scoreboard apparatus includes an electronic analysis and report mechanism 12, also known herein as the "electronic mechanism."

Figure 3:
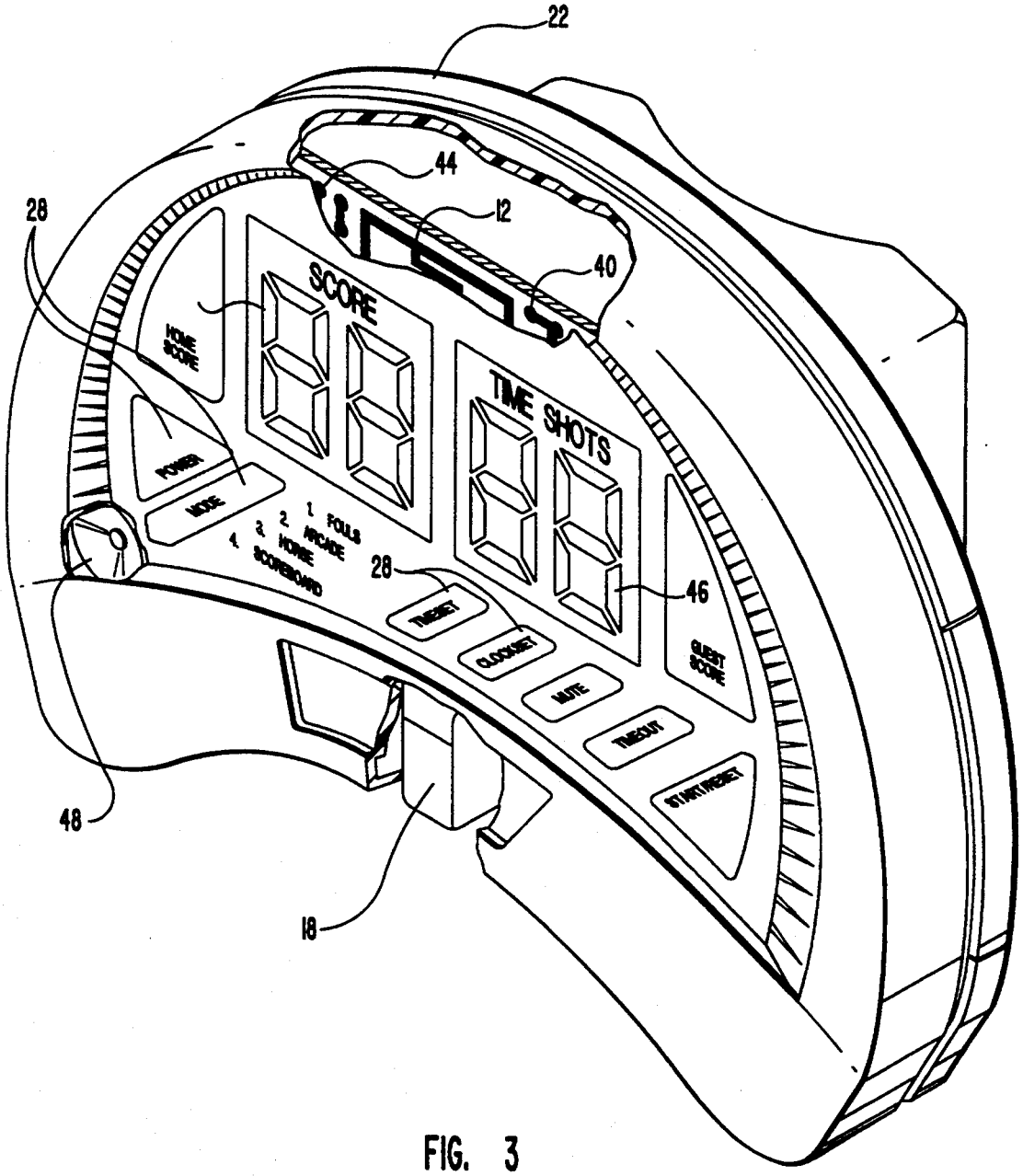
FIG. 3 is a perspective view of the housing with a portion cut-away to illustrate the electronic circuitry of the electronic mechanism, vibration filter, and paddle filter, another portion cut-away to illustrate the speaker, and a third portion cut-away to show the telephone jack.
Figure 4:
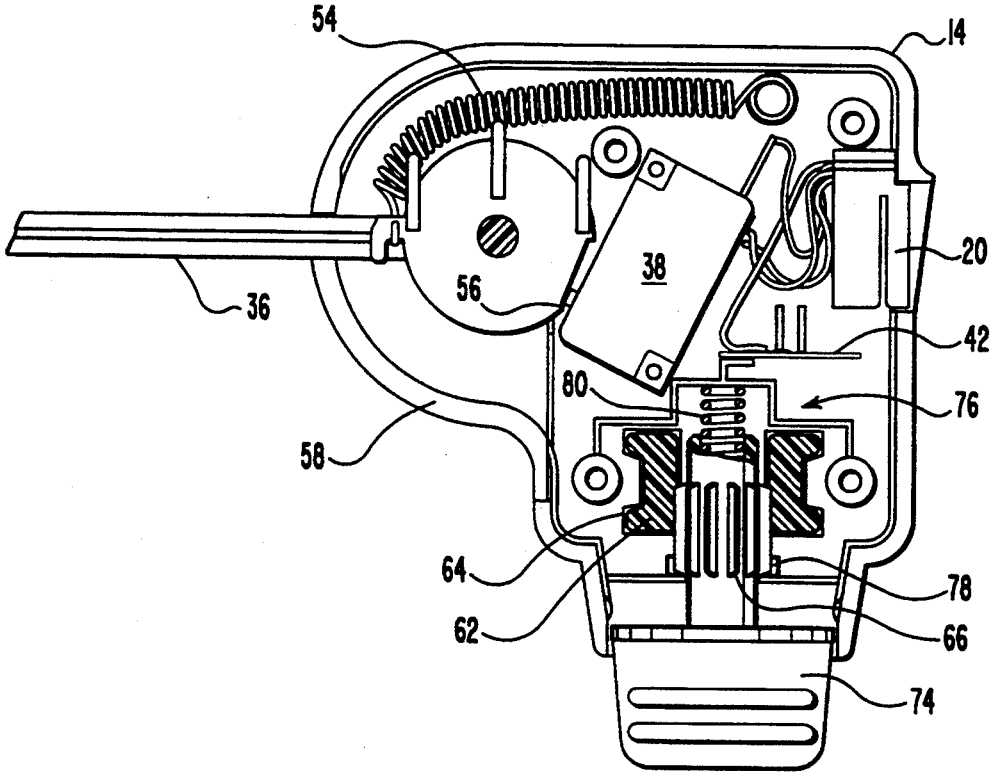
FIG. 4 is a side plan view of the attempt detection means with half the casing removed showing the piezoelectric vibration sensor, the paddle cam and switch with the paddle in its ready position, and the releasable gear locking mechanism in its engaged position.
Figure 5:
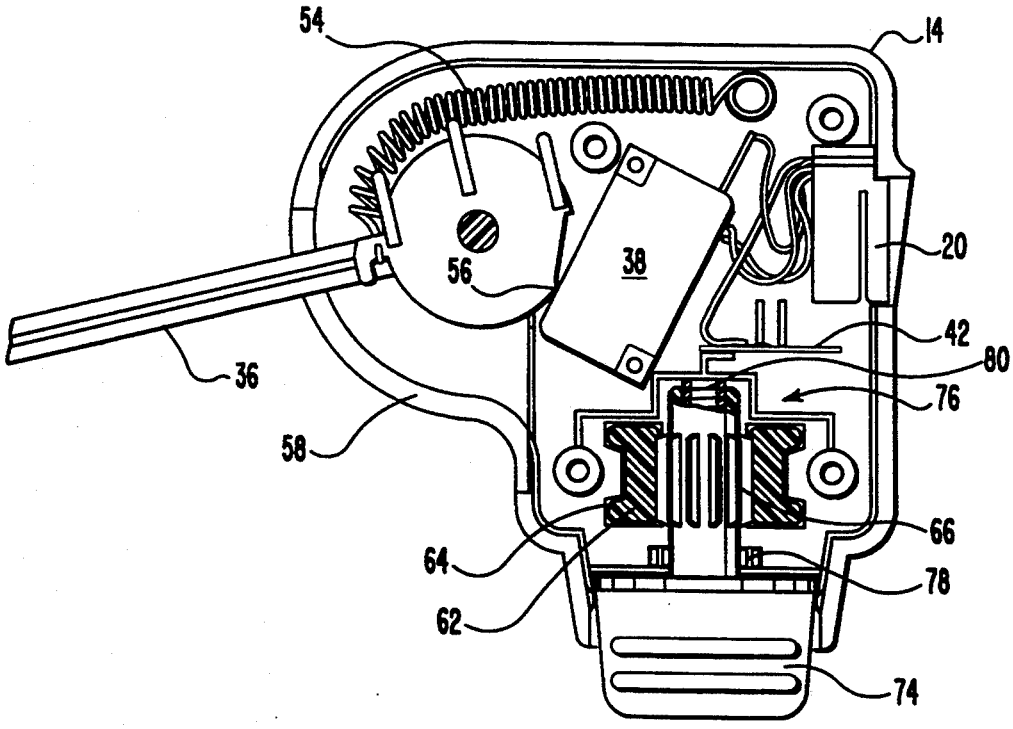
FIG. 5 is a side plan view of the attempt detection means with half the casing removed showing the piezoelectric vibration sensor, the paddle cam and switch with the paddle in its reactive position, and the releasable gear locking mechanism in its released position.

The electronic mechanism 12 is in signal communication with an attempt detection means, indicated generally at 14 in FIG. 1. In a preferred embodiment, communication occurs over a standard telephone wire 16 which mates at each end with standard telephone jacks to connect the electronic mechanism with the attempt detection means. The telephone jacks 18, 20 are best shown in FIGS. 3 through 5. Those of skill in the art will appreciate that other signal communication means, including radio or fiber optic devices, may also be used and so lie within the scope of the present invention.

As best illustrated in FIG. 3, the electronic mechanism 12 is housed for convenience and protection within a housing 22 that may be mounted on a basketball pole, a wall, or another convenient location. FIG. 1 shows the housing mounted on a basketball pole 24 with a wrap-around strap 26. The housing 22 may be a housing such as that disclosed and claimed in U.S. patent application Ser. No. 07/829,455, known hereafter as the '455 application, and may be mounted according to the teachings of said '455 application or according to other known means.

With reference now to FIG. 3, the electronic mechanism 12 is capable of receiving input information, analyzing the input information according to a variety of modes of operation, and reporting output information. As to input, the electronic mechanism 12 has a plurality of actuators 28 for players to use in manually inputting information. Players may also enter information through a remote control device (30 in FIG. 6) that is in wireless signal communication with the electronic mechanism 12 through a conventional transmitter 32 and receiver 34. As explained below, the electronic mechanism 12 also receives information from the attempt detection means 14.

The input information may include the desired mode of operation, such as one-player mode versus two-player mode, and other useful information including but not limited to information described in the '455 application. In a presently preferred embodiment, the information input to the electronic mechanism 12 includes a passage signal indicating successful passage of a basketball through the basketball hoop, and a contact signal indicating contact of a basketball with the backboard or hoop. The passage signals and contact signals are generated in a fashion explained below by a paddle 36, a switch 38, a paddle filter 40, a vibration sensor 42, and a vibration filter 44, whose communication paths to the electronic mechanism 12 are illustrated in schematic form in FIG. 6.

As to analysis, the capabilities of the electronic mechanism 12 may include, but are not limited to, the functions disclosed and claimed in the '455 application. Additional capabilities are also disclosed below in connection with the processing of signals transmitted from the attempt detection means 14 to the electronic mechanism 12.

As to output, the electronic mechanism 12 has a visual display 46, best illustrated in FIG. 3, for reporting information, and a speaker 48 for producing audible output. In a presently preferred embodiment, the output information emitted by the electronic mechanism 12 includes, but is not limited to, an indication of the number of successful shots, the time left on a shot clock, and an indication of the shooting percentage.

As shown in FIG. 3, the electronic mechanism 12 includes conventional electronic circuitry and microprocessors known to those skilled in electronic arts relating to signal processing, informational displays, and the like. Such electronic components regulate the various functions of the electronic scoreboard by converting the input information received into output signals. The output signals are then made perceptible to players by the visual display 46 or speaker 48. Because the electronic scoreboard is intended to be portable, the electronic mechanism 12 is preferably powered by batteries (not shown) disposed within the housing 22.

As noted above, the portable electronic scoreboard apparatus also includes an attempt detection means 14. As used herein, "attempt" includes both successful shots, in which a basketball passes through the basketball hoop (50 in FIG. 1), and close but unsuccessful shots, in which the basketball impacts the hoop, backboard, or basketball pole but does not pass through the hoop. Shots that completely miss the basketball standard are not detected as attempts.

As illustrated in FIG. 1, a portion of the attempt detection means 14 including a paddle 36 is attachable to a rim plate portion 52 of the basketball goal. As illustrated in FIG. 3, a presently preferred embodiment has additional portions of the attempt detection means 14 disposed within the housing 22 adjacent the electronic mechanism 12. These additional portions include the paddle filter 40 and the vibration filter 44, which comprise conventional electronic circuits and are described below.

A presently preferred embodiment includes a piezoelectric wafer vibration sensor 42, shown in FIGS. 4 and 5. Properly attached to the basketball standard as shown in FIG. 1, the attempt detection means 14 detects contacts of a basketball with the standard by means of the vibration sensor. Although a piezoelectric sensor is presently preferred, those of skill in the art will appreciate that mercury switches, leaf electrode switches, and other vibration sensors may also be used and so lie within the intended scope of the present invention.

Figure 6:
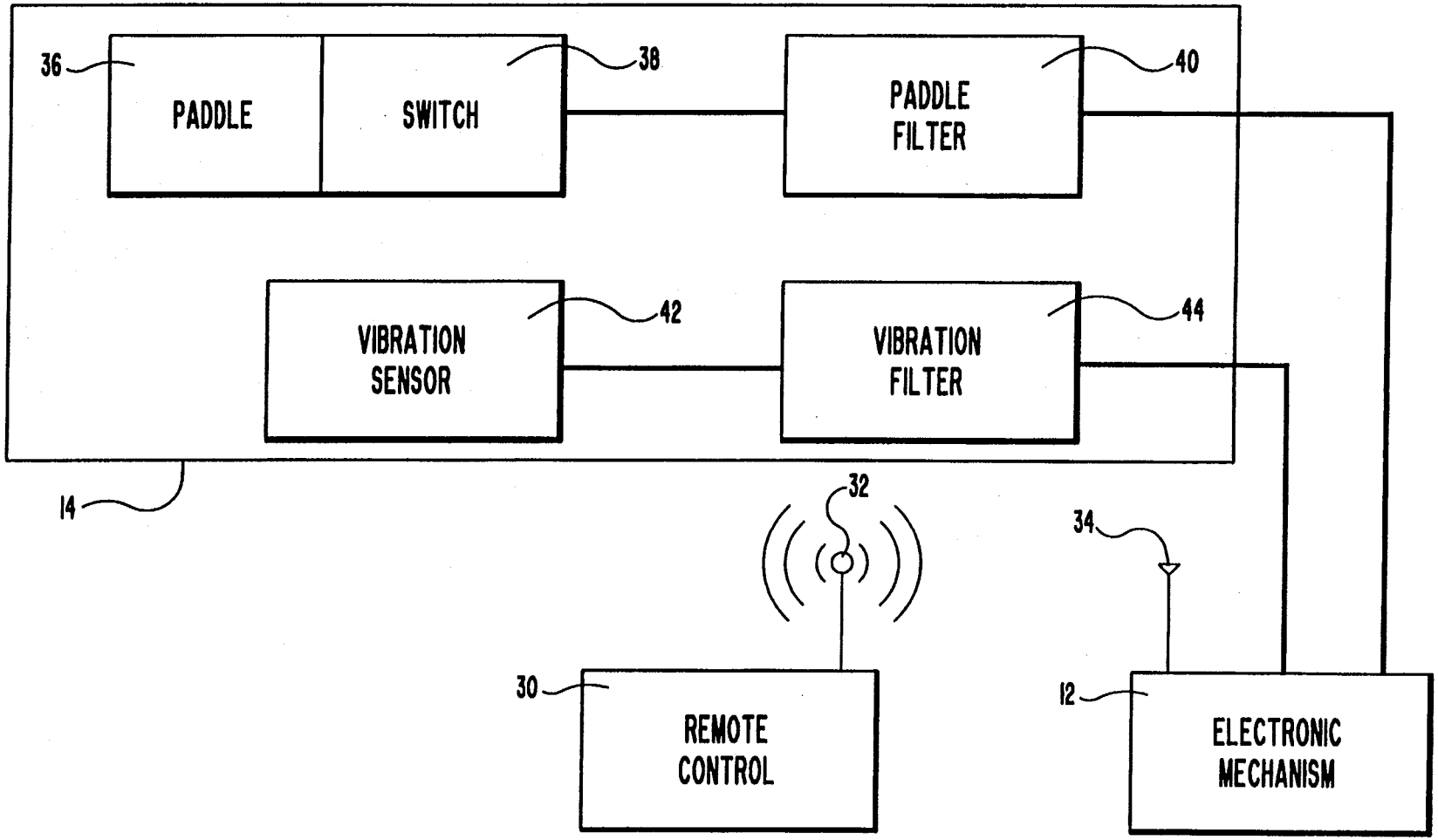
FIG. 6 is a schematic diagram of the electronic scoreboard of the present invention showing signal communication links between the switch, paddle filter, vibration sensor, vibration filter, remote control, and electronic mechanism of a preferred embodiment of the invention.

As illustrated in FIGS. 3 and 6, a presently preferred embodiment of the attempt detection means also includes a vibration filter 44 disposed within the housing 22 adjacent and in signal communication with the electronic mechanism 12. The vibration filter 44 comprises conventional electronic circuitry which functions in the manner described below. Referring now to FIGS. 1, 3, 4, and 6, it will be appreciated that if the vibration sensor 42 is actuated by an impact of the basketball against the backboard, hoop, or pole, the vibration sensor 42 sends a vibration signal to the vibration filter 44. Upon receiving an initial such vibration signal, the vibration filter 44 sends a contact signal to the electronic mechanism 12.

However, not every vibration signal results in a contact signal. The vibration filter 44 prevents spurious contact signals from being sent for a predetermined period of time after the vibration sensor 42 senses a contact. For instance, suppose the basketball strikes the backboard, then strikes the rim shortly thereafter, and finally bounces down to the court floor. The vibration sensor 42 sends a vibration signal along the wire 16 to the vibration filter 44 upon the impact against the backboard, and sends a second vibration signal upon the impact against the rim. However, the vibration filter 44 only sends one contact signal to the electronic mechanism 12 because the impacts occurred too near in time to one another.

Figure 2:
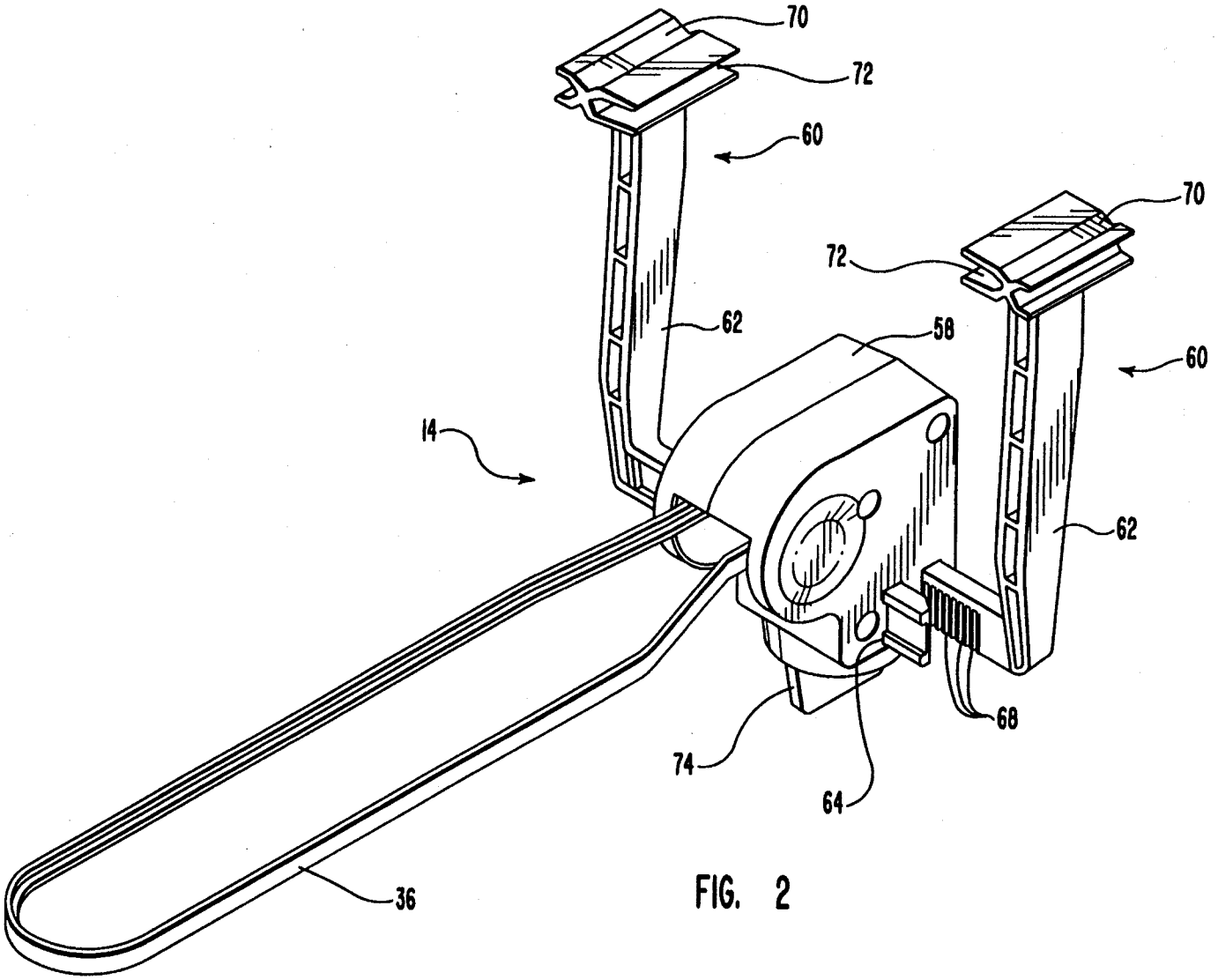
FIG. 2 is a perspective view of a portion of the attempt detection means illustrating the notched arms and grooved feet of the attachment assembly.

Passage signals are also preferably filtered. Referring now to FIGS. 1 and 2, the attempt detection means includes a paddle 36. The paddle 36 permits the attempt detection means 14 to detect the successful passage of a basketball through the basketball hoop 50. The paddle 36 is movable between a ready position, as shown in FIG. 4, and a reactive position, as shown in FIG. 5, in response to passage of a basketball through the hoop. A spring 54 urges the paddle 36 into the ready position.

As illustrated in FIG. 1, the paddle 36 is capable of placement beneath the rim 50 of the basketball goal. With the paddle 36 thus placed, a basketball successfully passing through the hoop 50 moves the paddle 36 from the ready position to the reactive position. As illustrated in FIG. 5, a cam 56 on the paddle actuates the switch 38 if the paddle 36 is in the reactive position.

A presently preferred embodiment, illustrated in FIGS. 3 and 6, includes a paddle filter 40. The paddle filter 40 comprises conventional electronic circuitry disposed within the housing 22 adjacent the electronic mechanism 12. Upon being actuated by the paddle cam 56 as shown in FIG. 5, the switch 38 sends a reactive paddle signal to the paddle filter 40.

With reference now to FIGS. 3 through 6, it will be appreciated that the paddle filter 40 prevents spurious passage signals from being sent to the electronic mechanism 12 for a predetermined period of time after the switch 38 is initially actuated by the paddle 36. On occasion the paddle 36 may bounce up and down several times after being flipped into its reactive position by the passing basketball, thereby causing the switch 38 to generate several reactive paddle signals for a single shot at the basket. The paddle filter 40 transmits a passage signal to the electronic mechanism 12 upon receipt of an initial reactive paddle signal from the switch 38. The paddle filter 40 then receives any additional reactive paddle signals while the paddle 36 is oscillating, but sends no further passage signal for a predetermined period of time afterward. Thus, the electronic mechanism 12 receives only one passage signal per passage of the basketball through the hoop.

The contact signals and passage signals from the attempt detection mechanism 14 are used by the electronic mechanism 12 to calculate shooting percentages for display. A player's shooting percentage is defined as the number of successful shots, as indicated by the number of passage signals received when the player has possession of the ball, divided by the total number of attempts by the player, as indicated by the number of contact signals plus the number of passage signals not immediately preceded by contact signal. The electronic mechanism 12 also properly scores a "swish," a successful shot in which the basketball passes through the hoop without first contacting the backboard or hoop. A swish is indicated by a passage signal not immediately preceded by a contact signal.

As shown in FIG. 4, the switch 38, vibration sensor 42, and part of the paddle 36 are enclosed in a casing 58. The casing 58 is attachable to the basketball goal by an attachment assembly 60, indicated generally at 60 in FIG. 2. The attachment assembly 60 includes a pair of arms 62 that extend through openings 64 in the casing 58. FIGS. 4 and 5 show the arms 62 in cross section within the casing 58. Also disposed inside the casing 58 is a gear 66. Each arm 62 has notches 68, best shown in FIG. 2, for engaging the gear 66 as illustrated in FIG. 5.

In addition, as FIGS. 1 and 2 illustrate, each arm 62 has a grooved foot 70 configured to engage the rim plate portion 52 of the basketball goal. It is presently preferred that the inside groove 72 of each foot be relatively deep to assist in securely attaching the casing 58 to the rim plate 52. The attachment, illustrated in FIG. 1, is accomplished using the notched arms 62 shown in FIG. 2 in engagement with the gear 66, as shown in FIGS. 4 and 5.

With the casing 58 positioned near the rim plate 52, the feet 70 engage or disengage the rim plate 52 as the feet 70 move closer together or further apart from one another, respectively. The feet 70 move when the arms 62 to which the feet 70 are attached move. The arms 62, in turn, move in response to pressure from the gear 66 on the notches 68. The gear 66 is secured to a knob 74 located outside the casing. The knob 74 is shown in FIGS. 1, 2, 4 and 5.

As the knob 74 is turned by a player, the gear 66 rotates and engages successive notches 68, thereby moving the arms 62. The feet 70 of the arms 62 move apart if the knob 74 is turned one direction, and move closer together if the knob 74 is turned the other direction.

The gear 66 is part of a releasable gear locking mechanism (indicated generally at 76) that has an engaged position, shown in FIG. 4, and a released position, shown in FIG. 5. In the engaged position, a notch 78 secured to the casing 58 tends to prevent the gear 66 from turning by engaging the gear 66. A spring 80 disposed in a cylindrical chamber in one end of the gear 66 urges the gear 66 into this engaged position. In the released position, by contrast, the gear 66 is released from the notch 78 and able to turn. Manual pressure by a player on the knob 74 is sufficient to compress the spring 80 and move the gear 66 from the engaged to the released position.

In summary, the present invention provides an apparatus for securely yet releasably engaging a score registering assembly so that repeated impacts on the assembly's paddle do not tend to loosen the assembly from the basketball goal. As FIG. 4 shows, the spring 80 tends to urge the gear 66 into a position in which notches 78 in the casing 58 prevent the gear 66 from turning. The gear 66, in turn, holds the arms 62 securely in place so that the feet 70, remain at a substantially constant distance from one another and hence remain engaged to the rim plate 52 as shown in FIG. 1. The deeper grooves 72 on the feet 70, shown best in FIG. 2, also assist in preventing the attachment assembly casing 58 from working loose.

As summarized in FIG. 6, the present invention also provides a basketball scoring apparatus which detects successful shots but does not generate false scores if the paddle 36 that is used to detect successful shots oscillates after being flipped by the basketball that went through the hoop. The paddle filter 40 filters out spurious reactive paddle signals on those rare occasions in which the paddle 36 actuates the switch 38 more than once right after the ball goes through the hoop. Through use of the vibration sensor 42 and the vibration filter 44 to properly detect contacts with the basketball standard, the present invention also provides a basketball scoring apparatus capable of detecting shots that hit the rim or backboard but do not pass through the hoop. Moreover, the electronic mechanism 12 is capable of calculating and displaying shot percentages based on the passage signals and contact signals it receives from the attempt detection means 14.

What is claimed and desired to be secured by patent is:

1. A portable electronic scoreboard apparatus attachable to a basketball goal having a hoop secured to a backboard by a rim plate, the apparatus comprising:

an electronic analysis and report mechanism capable of receiving input information, analyzing such input information according to a mode of operation, and reporting output information which includes an indication of the number of successful shots and an indication of the shooting percentage;

an attempt detection means for detecting contact of a basketball with the basketball hoop or the backboard and responsively sending a contact signal to said electronic analysis and report mechanism, and for detecting the successful passage of a basketball through the basketball hoop and responsively sending a passage signal to said electronic analysis and report mechanism, said attempt detection means comprising:

a vibration sensor capable of sensing vibrations caused by an impact of a basketball against the basketball hoop or backboard, a paddle movable between a ready position and a reactive position, said paddle being capable of placement beneath the hoop of the basketball goal such that a basketball successfully passing through the hoop moves said paddle from the ready position to the reactive position; and a switch disposed for actuation by said paddle and configured to emit a reactive paddle signal if said paddle moves to said reactive position.

2. A portable electronic scoreboard apparatus as set forth in claim 1, wherein said vibration sensor is capable of sending a vibration signal upon sensing such vibrations, said attempt detection means further comprising a vibration filter in signal communication with said vibration sensor and said electronic analysis and report mechanism, said vibration filter configured to send said contact signal to said electronic analysis and report mechanism upon initial receipt of said vibration signal, and said vibration filter further configured to not send said contact signal again for a predetermined period of time after said initial receipt.

3. A portable electronic scoreboard apparatus as set forth in claim 1, wherein said vibration sensor comprises a piezoelectric sensor.

4. A portable electronic scoreboard apparatus as set forth in claim 1, wherein said attempt detection means further comprises a paddle filter in signal communication with said switch and with said electronic analysis and report mechanism, said paddle filter configured to send said passage signal to said electronic analysis and report mechanism upon initial receipt of said reactive paddle signal, and said paddle filter further configured to not send said passage signal again for a predetermined period of time after said initial receipt.

5. A portable electronic scoreboard apparatus as set forth in claim 1, wherein said electronic analysis and report mechanism is capable of displaying output information which includes a percentage defined as the number of successful shots divided by the number of detected attempted shots.

6. A portable electronic scoreboard apparatus as set forth in claim 1, further comprising a remote control attachable to a player, said remote control in wireless signal communication with said electronic analysis and report mechanism for remotely inputting information to said electronic analysis and report mechanism.

7. A portable electronic scoreboard apparatus attachable to a basketball goal having a hoop secured to a backboard by a rim plate, the apparatus comprising:

an electronic analysis and report mechanism capable of receiving input information, analyzing such input information according to a mode of operation, and reporting output information which includes an indication of the number of successful shots and an indication of the shooting percentage;

an attempt detection means for detecting contact of a basketball with the basketball hoop or the backboard and responsively sending a contact signal to said electronic analysis and report mechanism, and for detecting the successful passage of a basketball through the basketball hoop and responsively sending a passage signal to said electronic analysis and report mechanism, said attempt detection means comprising:

a vibration sensor capable of sensing vibrations caused by an impact of a basketball against the basketball hoop or backboard; and an attachment assembly comprising:

a pair of arms each having a foot for engagement with the rim plate portion of the basketball goal and also having a series of successive notches; and a knob having a gear for engagement with said notches such that as said knob is turned, said gear turns to engage successive notches thereby advancing said pair of arms such that if said knob is turned one direction said foot of each arm moves closer together and if said knob is turned the other direction said foot of each arm moves farther apart.

8. A portable electronic scoreboard apparatus as set forth in claim 7, wherein each said foot has a pair of oppositely disposed side grooves for engaging the edge of the rim plate of the basketball goal.

9. A portable electronic scoreboard apparatus as set forth in claim 8, wherein one of said pair of oppositely disposed side grooves on each said foot is an inside groove, and wherein said inside groove is deeper than the other of said pair of side grooves on said foot for more securely engaging an outer edge of the rim plate of the basketball goal with said inside groove.

10. A portable electronic scoreboard apparatus as set forth in claim 7, wherein said attachment assembly further comprises a releasable gear locking mechanism having an engaged position, in which said locking mechanism engages said gear thereby tending to prevent said gear from turning, and a released position, in which said locking mechanism is released from engagement with said gear thereby permitting said gear to turn.

11. A portable electronic scoreboard apparatus as set forth in claim 10, wherein said releasable gear locking mechanism comprises a notch configured to engage said gear in said engaged position and to remain clear of said gear in said released position.

12. A portable electronic scoreboard apparatus as set forth in claim 10, further comprising an urging means tending to urge said gear locking mechanism into said engaged position.

13. A portable electronic scoreboard apparatus as set forth in claim 12, wherein said urging means comprises a spring.

14. A portable electronic scoreboard apparatus attachable to a basketball goal having a hoop secured to a backboard by a rim plate, the apparatus comprising:

an electronic analysis and report mechanism capable of receiving input information, analyzing such input information according to a mode of operation, and reporting output information which includes an indication of the number of successful shots and an indication of the shooting percentage; and an attempt detection means for detecting contact of a basketball with the basketball hoop or the backboard and responsively sending a contact signal to said electronic analysis and report mechanism, and for detecting the successful passage of a basketball through the basketball hoop and responsively sending a passage signal to said electronic analysis and report mechanism, said attempt detection means comprising a vibration sensor capable of sensing vibrations caused by an impact of a basketball against the basketball hoop or backboard;

wherein said electronic analysis and report mechanism further comprises a shot clock, said electronic analysis and report mechanism being capable of resetting said shot clock in response to receiving said contact signal or said passage signal from said attempt detection means.

* * * * *